US005878721A

United States Patent [19]

Nakamura

[11] Patent Number: 5,878,721

[45] Date of Patent: Mar. 9, 1999

[54] ENGINE CONTROL SYSTEM FOR CONSTRUCTION MACHINE

[75] Inventor: Kazunori Nakamura, Ibaraki-ken, Japan

[73] Assignee: Hitachi Construction Machinery Co., Ltd., Tokyo, Japan

[21] Appl. No.: 90,847

[22] Filed: Jun. 4, 1998

[30] Foreign Application Priority Data

Jun. 10, 1997 [JP] Japan ..... 9-152124

[51] Int. Cl.[6] ..... F02M 39/00

[52] U.S. Cl. ..... 123/496; 123/385

[58] Field of Search ..... 123/357, 496, 123/385, 386, 387

[56] References Cited

U.S. PATENT DOCUMENTS

| | | | |
|---|---|---|---|
| Re. 30,189 | 1/1980 | Perr | 123/496 |
| 4,211,203 | 7/1980 | Kobayashi | 123/496 |
| 4,275,691 | 6/1981 | Wolff | 123/385 |
| 4,638,779 | 1/1987 | Kitada | 123/385 |
| 4,774,921 | 10/1988 | Sakaguchi | 123/385 |
| 4,838,755 | 6/1989 | Johnson | 123/385 |
| 5,447,138 | 9/1995 | Barnes | 123/496 |
| 5,468,126 | 11/1995 | Lukich | 123/385 |
| 5,613,474 | 3/1997 | Nakamura | 123/496 |
| 5,619,969 | 4/1997 | Liu | 123/496 |
| 5,755,209 | 5/1998 | Fischer | 123/496 |

FOREIGN PATENT DOCUMENTS

| | | | |
|---|---|---|---|
| 45937 | 2/1989 | Japan | 123/496 |
| 1-121560 | 5/1989 | Japan . | |

OTHER PUBLICATIONS

Mechanization of Construction, Dec. 1996, No. 562, "Overview and Inspection/Servicing of Diesel Engine Adapted for Exhaust Gas Regulation", p. 63.

*Primary Examiner*—Carl S. Miller

*Attorney, Agent, or Firm*—Fay, Sharpe, Beall, Fagan, Minnich & McKee

[57] ABSTRACT

The pump controller determines pump load torques ($T_{r1}$, $T_{r2}$) from tilting signals ($\theta_1$, $\theta_2$) of hydraulic pumps and delivery pressure signals ( $P_{D1}$, $P_{D2}$) of the hydraulic pumps based on $T_{r1}=K\cdot\theta_1\cdot P_{D1}$ and $T_{r2}=K\cdot\theta_2\cdot P_{D2}$ (K: constant), and adds these pump load torques to provide a resulting value as an engine load torque signal (T). Using the signal (T) and an engine revolution speed signal, an engine controller determines a fuel injecting rate to control a pre-stroke actuator. Simultaneously, the engine controller calculates target injection timing not to change fuel injection start timing, thereby controlling a timer actuator. This makes it possible to control the fuel injection rate with good response and high accuracy following load fluctuation, achieve improved combustion, and hold a fuel injection period within an optimum angle range. As a result, optimum combustion is achieved and such a deterioration of exhaust gas as the generation of $NO_x$ and black smoke can be avoided.

5 Claims, 11 Drawing Sheets

PROCESSING IN PUMP CONTROLLER

PROCESSING IN ENGINE CONTROLLER

ENGINE CONTROL SYSTEM FOR CONSTRUCTION MACHINE

BACKGROUND OF THE INVENTION

1. Field of the Invention

The present invention relates to an engine control system for a construction machine, and more particularly to an engine control system for a construction machine such as a hydraulic excavator wherein a diesel engine having an electronic fuel injection device (electronic control governor) is used as a prime mover.

2. Description of the Related Art

A construction machine such as a hydraulic excavator generally includes at least one hydraulic pump for driving a plurality of actuators, and a diesel engine is used as a prime mover for rotatively driving the hydraulic pump. The diesel engine is controlled in injected fuel amount and fuel injection timing by a fuel injection device. With recent development of electronic control in the fuel injection device, in particular, a fuel injection rate has also become freely controllable in addition to the injected fuel amount and the fuel injection timing. As a result, good combustion is realized and engine performance is improved in a wide range.

In a fuel injection device for a diesel engine disclosed in JP, A, 1-121560, for example, a valve opening pressure is controlled such that it is lowered to stabilize an injection rate in a low-speed, low-load region, and is raised to increase the injection rate and shorten an injection period for avoiding the generation of black smoke in a low-speed, high-load region.

Further, the fuel injection timing has become freely controllable by determining the optimum injection timing depending on a status variable such as related to engine revolution, which also contributes to achieving good combustion.

Earlier timing of fuel injection provides a higher combustion temperature of fuel injected into a cylinder and hence better fuel efficiency (fuel consumption). As stated in, e.g., "Mechanization of Construction" (1996 DECEMBER No. 562), an article titled "Overview and Inspection/Servicing of Diesel Engine Adapted for Exhaust Gas Regulation (No. 2)", page 63, however, $NO_x$ meaning NO and $NO_2$ together, which are said to be responsible for photochemical smog, generally tends to be produced during high-speed, high-load operation. To make exhaust gas clean, therefore, a method of delaying the fuel injection timing during the high-speed, high-load operation, where $NO_x$ tends to be produced, is employed.

SUMMARY OF THE INVENTION

As mentioned above, the conventional electronic fuel injection device for a diesel engine has intended to realize good combustion by controlling the fuel injection rate depending on an engine load and an engine revolution speed. However, it has been hitherto general that the engine load is estimated from an engine revolution speed and an injected fuel amount, and is not accurately detected in a direct manner. This has raised the problem that the fuel injection rate cannot be controlled with high accuracy and there is a limit in effect of improving combustion.

Also, in the case of a diesel engine being used in a construction machine such as a hydraulic excavator, an object to be driven by the engine is a hydraulic pump. When a plurality of actuators are driven by a hydraulic pump, a delivery rate and a delivery pressure of the hydraulic pump are frequently changed and a load of the hydraulic pump, i.e., an engine load, is fluctuated. Accordingly, when injection rate control is performed by estimating the load based on the engine revolution speed and the injected fuel amount in such a diesel engine, in particular, the fuel injection rate cannot be controlled with good response following fluctuation in load of the hydraulic pump and a sufficient improvement of combustion cannot be obtained.

Furthermore, in conventional fuel injection timing control, the fuel injection timing is delayed by delaying the start timing of fuel injection. Because the delayed fuel injection timing delays the end timing of fuel injection, a fuel injection period is entirely shifted in a delay direction with respect to an angle of engine revolution. Accordingly, the fuel injection period with respect to the angle of engine revolution is deviated from an optimum angle range. This has also posed a limit in effect of improving combustion.

A first object of the present invention is to provide an engine control system for a construction machine with which, in a diesel engine for rotatively driving a hydraulic pump, combustion is improved and engine performance is enhanced by controlling a fuel injection rate with good response and high accuracy following load fluctuation.

A second object of the present invention is to provide an engine control system for a construction machine with which, in a diesel engine for rotatively driving a hydraulic pump, combustion is improved and engine performance is enhanced by making control resulted as if fuel injection timing is changed, by controlling a fuel injection rate while minimally changing the angle range of a fuel injection period with respect to an angle of engine revolution.

(1) To achieve the above first object, the present invention provides an engine control system for a construction machine comprising a diesel engine, at least one variable displacement hydraulic pump rotatively driven by the engine for driving a plurality of actuators, flow rate instruction means for instructing a delivery rate of the hydraulic pump, and an electronic fuel injection device for controlling an injected fuel amount in the engine, the electronic fuel injection device including a fuel injection rate control actuator for controlling a fuel injection rate of the engine, wherein the engine control system comprises first detecting means for detecting a status variable of the hydraulic pump, load calculating means for calculating a load of the hydraulic pump based on a value detected by the first detecting means, and injection rate calculation control means for operating the fuel injection rate control actuator so that the fuel injection rate depending on the load of the hydraulic pump is resulted.

Since the load calculating means calculates the load of the hydraulic pump based on the value detected by the first detecting means, an accurate load imposed on the engine can be determined. Since the injection rate calculation control means operates the fuel injection rate control actuator so that the fuel injection rate depending on the load of the hydraulic pump is resulted, the fuel injection rate can be controlled with good accuracy. Also, even when the delivery rate and delivery pressure of the hydraulic pump are frequently changed and the load of the hydraulic pump (engine load) is fluctuated, the fuel injection rate can be controlled with good response following the load fluctuation. Hence, an improvement of combustion is achieved and engine performance is enhanced.

(2) In the above (1), preferably, the first detecting means comprises means for detecting a delivery pressure of the hydraulic pump and means for detecting a tilting position of the hydraulic pump, and the load calculating means calculates the load of the hydraulic pump based on values detected by the delivery pressure detecting means and the tilting position detecting means.

With that feature, an accurate load imposed on the engine can be determined and the fuel injection rate can be controlled with good response and high accuracy following the load, similarly to the above (1).

(3) In the above (1), preferably, the first detecting means may comprise means for detecting a delivery pressure of the hydraulic pump, and the load calculating means may calculate the load of the hydraulic pump based on a value detected by the delivery pressure detecting means and a target tilting corresponding to the delivery rate of the hydraulic pump instructed by the flow rate instructing means.

Since the load of the hydraulic pump is calculated by using the target tilting which represents a value before the delivery rate of the hydraulic pump is actually changed, response in injection rate control following fluctuation in the load of the hydraulic pump (engine load) is further improved, the injection rate control can be made with higher accuracy, and a further improvement of combustion can be achieved.

(4) To achieve the above second object, the engine control system of the present invention in the above (1) further comprises second detecting means for detecting a revolution speed of the engine, the injection rate calculation control means determines, based on the load of the hydraulic pump and the revolution speed of the engine, an injection rate command value causing the fuel injection rate to reduce as the load of the hydraulic pump increases or as the revolution speed of the engine lowers, and the electronic fuel injection device further includes injection timing control means for making control such that fuel injection start timing is not essentially changed regardless of the fuel injection rate.

By so controlling the fuel injection rate and the fuel injection start timing in combination with control of the injected fuel amount, the control can be made to delay the timing at which the injection rate reaches a peak, but not to delay the fuel injection start timing, as the load of the hydraulic pump (engine load) increases. This enables the control to be performed as if the fuel injection timing is delayed, while minimizing change in the angle range of a fuel injection period with respect to an angle of engine revolution. Accordingly, the injection timing control can be performed while holding the fuel injection period within an optimum angle range, and combustion can be further improved in points such as suppressing the generation of $NO_x$ and black smoke.

(5) Further, to achieve the above second object, the present invention provides an engine control system for a construction machine comprising a diesel engine and an electronic fuel injection device for controlling an injected fuel amount in the engine, wherein the engine control system comprises means for detecting a load of the engine, means for detecting a revolution speed of the engine, and fuel injection control means for making control, based on the load of the engine and the revolution speed of the engine, such that a fuel injection rate reduces as the load of the engine increases or as the revolution speed of the engine lowers, and fuel injection start timing is not essentially changed regardless of the fuel injection rate.

With that feature, similarly to the above (4), the control can be performed as if the fuel injection timing is delayed, while minimizing change in the angle range of the fuel injection period with respect to the angle of engine revolution. Accordingly, the injection timing control can be performed while holding the fuel injection period within an optimum angle range, and combustion can be further improved in points such as suppressing the generation of $NO_x$ and black smoke.

DESCRIPTION OF THE PREFERRED EMBODIMENTS

Embodiments of the present invention will be described hereunder with reference to the drawings.

To begin with, a first embodiment of the present invention will be below described with reference to FIGS. 1 to 9.

Figure 1:
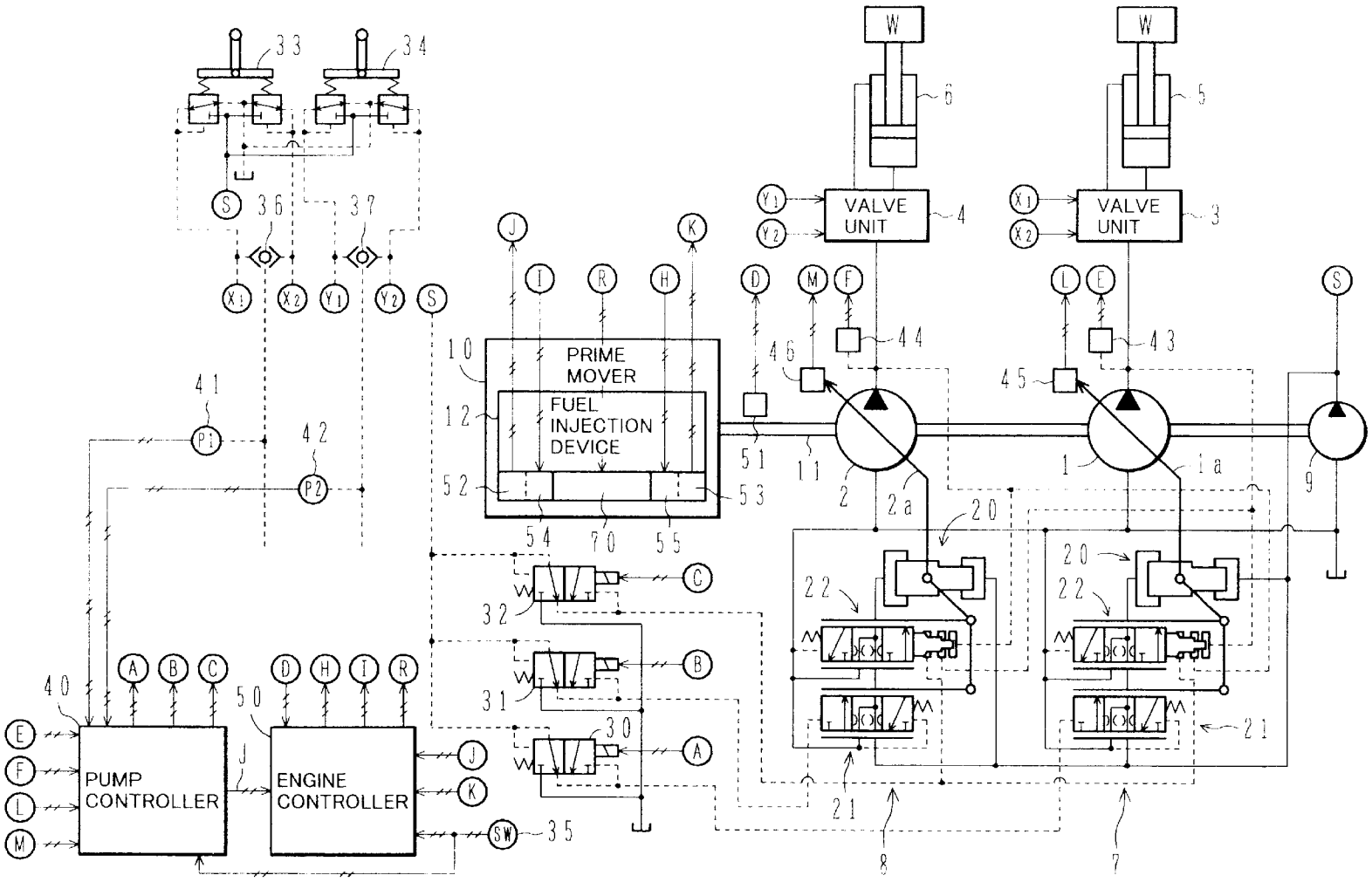
FIG. 1 is a diagram showing an entire configuration of an engine control system according to a first embodiment of the present invention along with a hydraulic circuit and a pump control system.

In FIG. 1, reference numerals 1 and 2 denote variable displacement hydraulic pumps. The hydraulic pumps 1, 2 are connected to actuators 5, 6 through valve units 3, 4, respectively, and the actuators 5, 6 are driven by hydraulic fluids delivered from the hydraulic pumps 1, 2. The actuators 5, 6 are hydraulic cylinders for, e.g., moving a boom, an arm, etc. which constitute a working front of a hydraulic excavator, and predetermined work is performed with driving of the actuators 5, 6. Commands for driving the actuators 5, 6 are applied from control lever units 33, 34 and the valve units 3, 4 are operated upon the control lever units 33, 34 being manipulated.

The hydraulic pumps 1, 2 are, by way of example, swash plate pumps wherein tiltings of swash plates 1*a*, 1*b* serving as displacement varying mechanisms are controlled by regulators 7, 8 to control respective pump delivery rates.

Denoted by 9 is a fixed displacement pilot pump serving as a pilot pressure generating source which generates a hydraulic pressure signal and a hydraulic fluid for control.

The hydraulic pumps 1, 2 and the pilot pump 9 are coupled to an output shaft 11 of a prime mover 10 and are rotatively driven by the prime mover 10. The prime mover 10 is a diesel engine and includes an electronic fuel injection device 12. A target revolution speed of the prime mover 10 is commanded by an accelerator operation input unit 35.

The regulators 7, 8 of the hydraulic pumps 1, 2 comprise, respectively, tilting actuators 20, 20, first servo valves 21, 21 for positive tilting control, and second servo valves 22, 22 for input torque limiting control. The servo valves 21, 22 control hydraulic fluid pressures acting on the tilting actuators 20 from the pilot pump 9.

Figure 2:
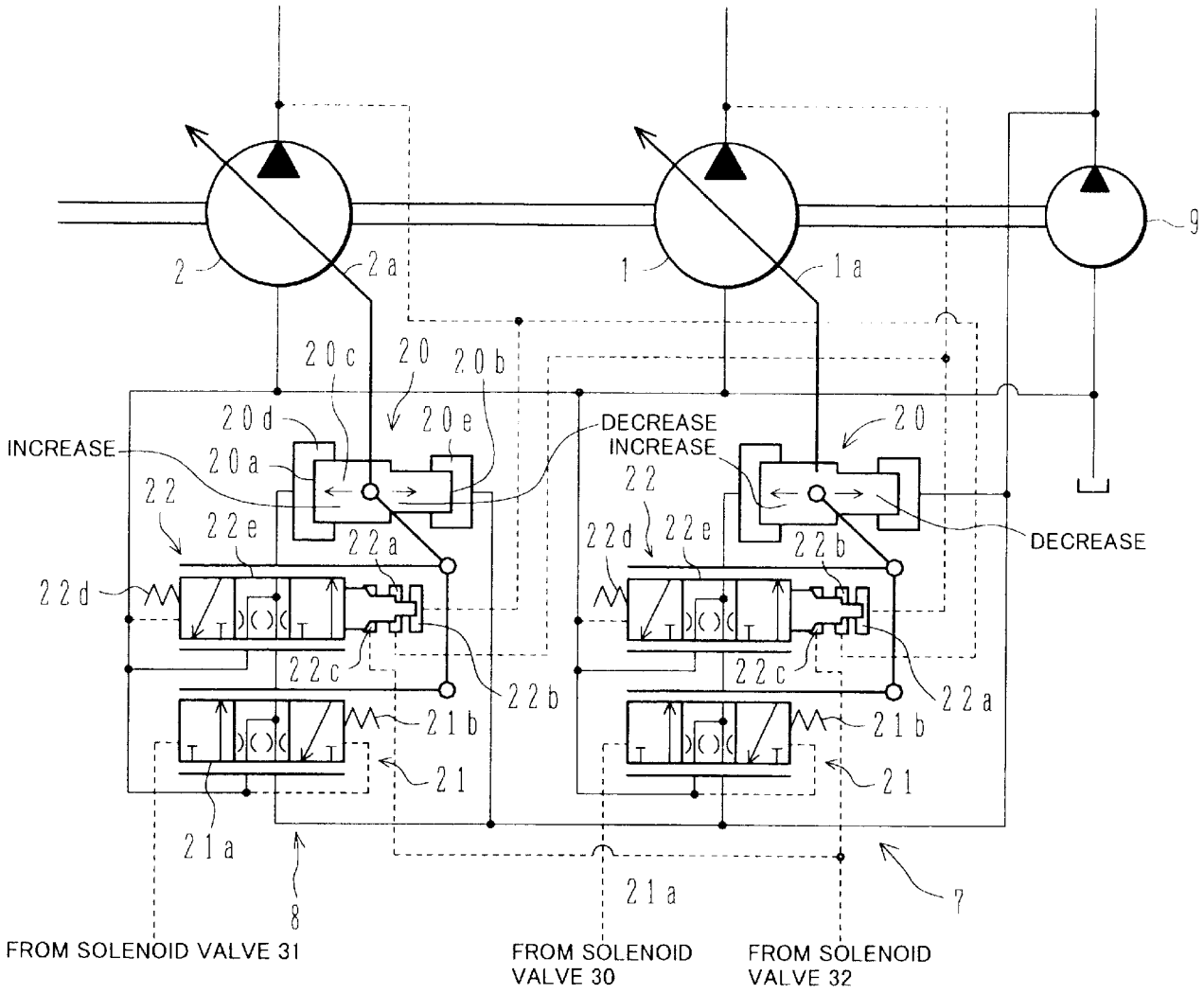
FIG. 2 is an enlarged view of a regulator section of a hydraulic pump.

The regulators 7, 8 of the hydraulic pumps 1, 2 are shown in FIG. 2 in an enlarged scale. The tilting actuators 20 each comprise an operating piston 20*c* provided with a large-diameter pressure bearing portion 20*a* and a small-diameter pressure bearing portion 20*b* at opposite ends thereof, and pressure bearing chambers 20*d*, 20*e* in which the pressure bearing portions 20*a*, 20*b* are positioned respectively. When pressures in both the pressure bearing chambers 20*d*, 20*e* are equal to each other, the operating piston 20*c* is moved to the right on the drawing due to an area difference between the pressure bearing portions 20*a*, 20*b*, whereupon the tilting of the swash plate 1*a* or 2*a* is diminished to reduce the pump delivery rate. When the pressure in the pressure bearing chamber 20*d* on the large-diameter side lowers, the operating piston 20*c* is moved to the left on the drawing, whereupon the tilting of the swash plate 1*a* or 2*a* is enlarged to increase the pump delivery rate. Further, the pressure bearing chamber 20*d* on the large-diameter side is connected to a delivery line of the pilot pump 9 through the first and second servo valves 21, 22, whereas the pressure bearing chamber 20*e* on the small-diameter side is directly connected to the delivery line of the pilot pump 9.

The first servo valves 21 for positive tilting control are each a valve operated by a control pressure from a solenoid control valve 30 or 31. When the control pressure is high, a valve body 21*a* is moved to the right on the drawing, causing a pilot pressure from the pilot pump 9 to be transmitted to the pressure bearing chamber 20*d* without being reduced, whereby the delivery rate of the hydraulic pump 1 or 2 is reduced. As the control pressure lowers, the valve body 21*a* is moved to the left on the drawing by force of a spring 21*b*, causing the pilot pressure from the pilot pump 9 to be transmitted to the pressure bearing chamber 20*d* after being reduced, whereby the delivery rate of the hydraulic pump 1 or 2 is increased.

The second servo valves 22 for input torque limiting control are each a valve operated by delivery pressures of the hydraulic pumps 1 and 2 and a control pressure from a solenoid control valve 32. The delivery pressures of the hydraulic pumps 1 and 2 and the control pressure from the solenoid control valve 32 are introduced respectively to pressure bearing chambers 22*a*, 22*b*, 22*c* of operation drivers. When the sum of hydraulic pressure forces given by the delivery pressures of the hydraulic pumps 1 and 2 is lower than a setting value which is determined by a difference between resilient force of a spring 22*d* and hydraulic pressure force given by the control pressure introduced to the pressure bearing chamber 22*c*, a valve body 22*e* is moved to the right on the drawing, causing the pilot pressure from the pilot pump 9 to be transmitted to the pressure bearing chamber 20*d* after being reduced, whereby the delivery rate of the hydraulic pump 1 or 2 is increased. As the sum of hydraulic pressure forces given by the delivery pressures of the hydraulic pumps 1 and 2 rises over the setting value, the valve body 22*e* is moved to the left on the drawing, causing the pilot pressure from the pilot pump 9 to be transmitted to the pressure bearing chamber 20*d* without being reduced, whereby the delivery rate of the hydraulic pump 1 or 2 is reduced. Further, when the control pressure from the solenoid control valve 32 is low, the setting value is increased so that the delivery rate of the hydraulic pump 1 or 2 starts reducing from a relatively high delivery pressure of the hydraulic pump 1 or 2, and as the control pressure from the solenoid control valve 32 rises, the setting value is decreased so that the delivery rate of the hydraulic pump 1 or 2 starts reducing from a relatively low delivery pressure of the hydraulic pump 1 or 2.

The solenoid control valves 30, 31 are operated (as described later) to maximize the control pressures output from them when the control lever units 33, 34 are in neutral positions, and when the control lever units 33, 34 are manipulated, to lower the control pressures output from them with an increase in respective input amounts by which the control lever units 33, 34 are manipulated. The solenoid control valve 32 is operated (as described later) to lower the control pressure output from it as the target revolution speed indicated by an accelerator signal output from the accelerator operation input unit 35.

As explained above, as the input amounts of the control lever units 33, 34 increase, the tiltings of the hydraulic pumps 1, 2 are controlled so that the delivery rates of the hydraulic pumps 1, 2 are increased to provide the delivery rates adapted for demanded flow rates of the valve units 3, 4. In addition, as the delivery pressures of the hydraulic pumps 1, 2 rise, or as the target revolution speed input from the accelerator operation input unit 35 lowers, the tiltings of the hydraulic pumps 1, 2 are controlled so that maximum values of the delivery rates of the hydraulic pumps 1, 2 are limited to smaller values to keep the load of the hydraulic pump 1 from exceeding the output torque of the prime mover 10.

Returning to FIG. 1, reference numeral 40 denotes a pump controller and 50 an engine controller.

The pump controller 40 receives detection signals from pressure sensors 41, 42, 43, 44 and position sensors 45, 46, as well as the accelerator signal from the accelerator operation input unit 35. After executing predetermined processing, the pump controller 40 outputs control currents to the solenoid control valves 30, 31, 32 and an engine load torque signal to the engine controller 50.

The control lever units 33, 34 are of the hydraulic pilot type producing and outputting a pilot pressure as an operation signal. Shuttle valves 36, 37 for detecting the pilot pressures are provided in respective pilot circuits of the control lever units 33, 34, and the pressure sensors 41, 42 electrically detect the respective pilot pressures detected by shuttle valves 36, 37. Also, the pressure sensors 43, 44 electrically detect the respective delivery pressures of the hydraulic pumps 1, 2, and the position sensors 45, 46 electrically detect the respective tiltings of the swash plates 1*a*, 2*a* of the hydraulic pumps 1, 2.

The engine controller 50 receives not only the accelerator signal from the accelerator operation input unit 35 and the engine load torque signal from the pump controller 40, but also detection signals from a revolution speed sensor 51, a link position sensor 52 and a lead angle sensor 53. After executing predetermined processing, the engine controller 50 outputs control currents to an governor actuator 54, a timer actuator 55 and a pre-stroke actuator 70. The revolution speed sensor 51 detects the revolution speed of the engine 10.

Figure 3:
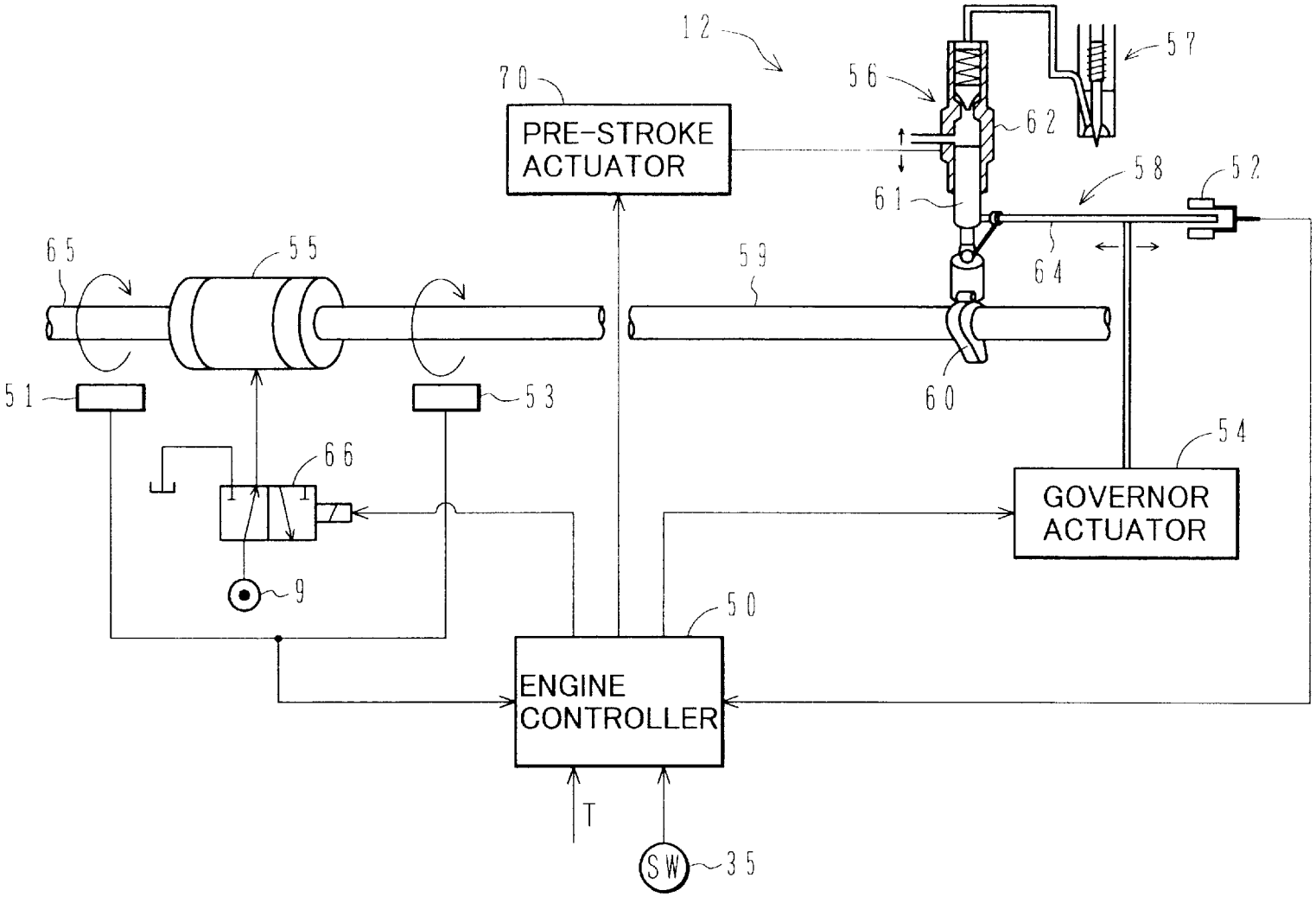
FIG. 3 is a diagram showing a schematic configuration of an electronic fuel injection device.

FIG. 3 shows an outline of the electronic fuel injection device 12 and a control system for it. In FIG. 3, the electronic fuel injection device 12 comprises an injection pump 56, an injection nozzle 57 and a governor mechanism 58 for each cylinder of the engine 10. The injection pump 56 basically comprises a plunger 61 and a timing sleeve 62 within which the plunger 61 is vertically movable. When a cam shaft 59 is rotated, a cam 60 mounted on the cam shaft 59 pushes up the plunger 61 and then pressurize fuel upon the rotation. The pressurized fuel is delivered to a nozzle 57 and injected into the engine cylinder. The cam shaft 59 is rotated in association with a crankshaft of the engine 10.

The cam 60 is a concave cam and serves to push up the plunger 61 for pressurizing fuel. On the other hand, the timing sleeve 62 is vertically moved by the pre-stroke actuator 70. A combination of the cam 60 and the pre-stroke actuator 70 controls a injection rate (as described later).

Also, the governor mechanism 58 comprises the governor actuator 54 and a link mechanism 64 of which position is controlled by the governor actuator 54. The link mechanism 64 rotates the plunger 61 to change the positional relationship between a lead 73 (see FIG. 4) provided in the plunger 61 and a fuel intake port 74 (see FIG. 4) formed in the timing sleeve 62, whereby an effective compression stroke of the plunger 61 is changed to adjust the injected fuel amount. The link position sensor 52 is provided in the link mechanism to detect the link position. The governor actuator 54 is, e.g., an electromagnetic solenoid.

Further, the electronic fuel injection device 12 includes the timer actuator 55 which advances a lead angle of the cam shaft 59 with respect to rotation of a shaft 65 coupled to the crankshaft for phase adjustment to adjust the fuel injection timing. Because of necessity of transmitting a drive torque to the injection pump 56, the timer actuator 55 is required to produce large force enough for the phase adjustment. For that reason, the timer actuator 55 includes a hydraulic actuator built in it and is provided with a solenoid control valve 66 for converting the control current from the engine controller 50 into a hydraulic pressure signal and advancing the lead angle of the cam shaft 59 in a hydraulic manner. The revolution speed sensor 51 is provided to detect a revolution speed of the shaft 65 and the lead angle sensor 53 is provided to detect a revolution speed of the cam shaft 59.

Figure 4:
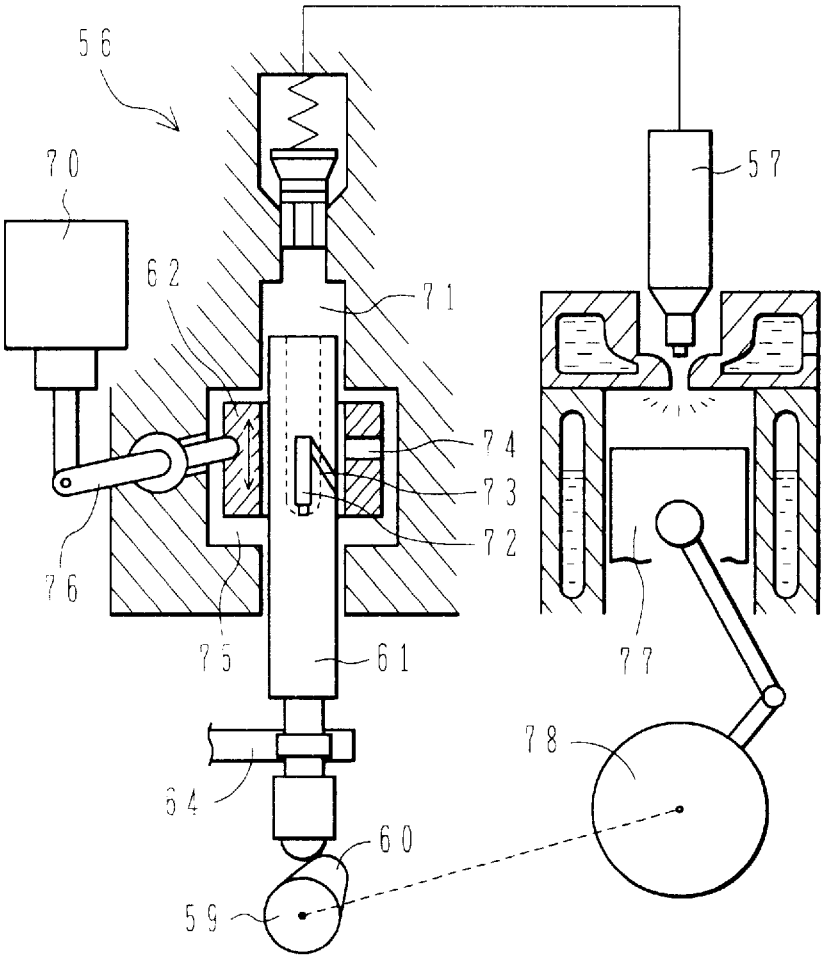
FIG. 4 is a view showing details of an injection pump.

FIG. 4 shows details of the injection pump 56. A suction port 72 and the lead 73 in communication with a high pressure chamber 71 are formed in the plunger 61, and the fuel intake port 74 is formed in the timing sleeve 62. The timing sleeve 62 is positioned in a fuel chamber 75 and a plunger 61 is inserted in the timing sleeve 62. The pre-stroke actuator 70 is coupled to the timing sleeve 62 through a control rod 76, whereby the timing sleeve 62 is vertically adjustable with respect to the plunger 61 to variably control a pre-stroke (stroke amount prior to the start of injection) of the plunger 61. Specifically, in response to change in vertical position of the timing sleeve 62, a stroke position at which the suction port 72 is closed when the plunger 61 moves upward is changed and hence the pre-stroke is also changed. Here, the shorter pre-stroke advances the injection timing and the longer pre-stroke delays the injection timing. Denoted by 77 is a cylinder and 78 is a crankshaft.

Figure 5:
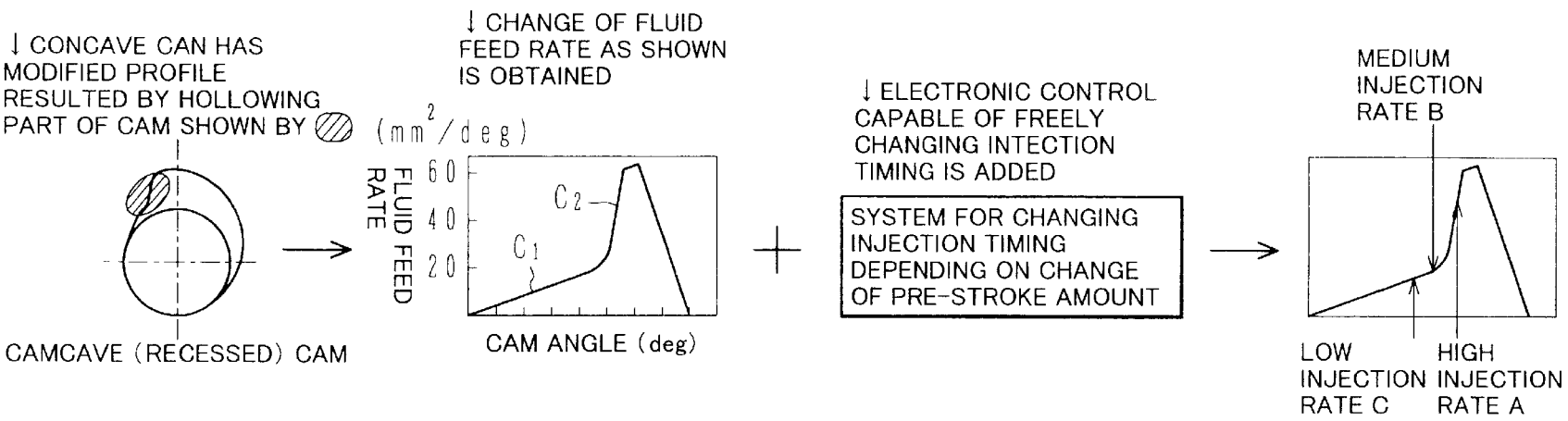
FIG. 5 is a representation for explaining the principle of injection rate control based on pre-stroke control.

FIG. 5 is a representation for explaining the principle of injection rate control based on a combination of the concave cam 60 and the pre-stroke control.

The concave cam 60 has a modified profile resulted by hollowing part of the cam as shown by a hatched area. By forming the concave cam 60 to have such a modified profile, a fluid feed rate with respect to a cam angle (engine revolution) has a characteristic including a gently sloped area C1 and a steeply sloped area C2. By combining such a characteristic with control capable of changing the injection timing based on change of the pre-stroke amount, the range of the fluid feed characteristic used is changed as indicated by A, B, C and the injection rate is also changed correspondigly. In other words, a high injection rate is obtained with a rapid lift displacement in the range A, a low injection rate is obtained with a slow lift displacement in the range C, and a medium injection rate is obtained in the range B.

Figure 6:
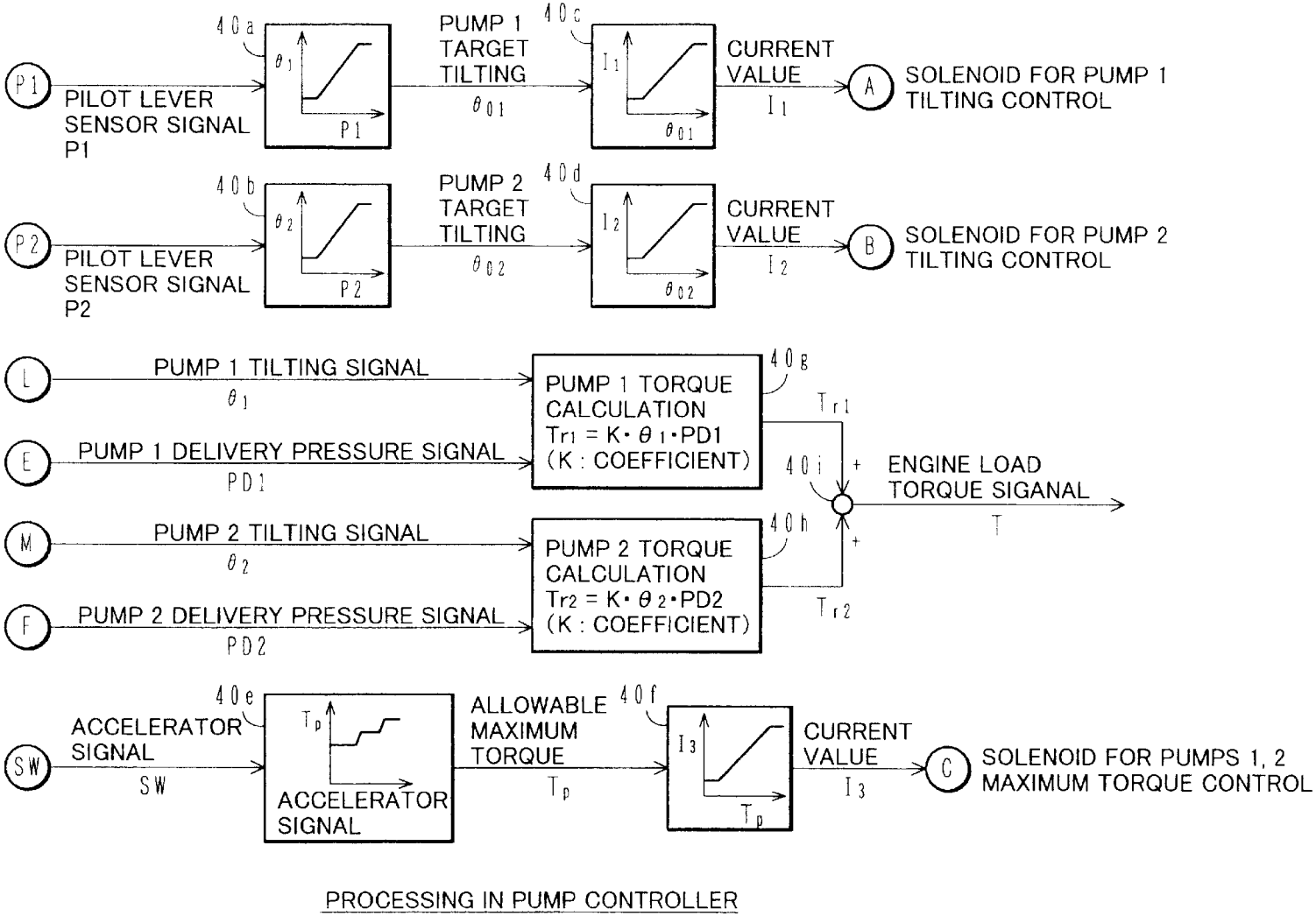
FIG. 6 is a functional block diagram showing a sequence of processing steps in a pump controller.

FIG. 6 shows a sequence of processing steps in the pump controller 40 in the form of a functional block diagram. In FIG. 6, the detection signals (pilot lever sensor signals P1 and P2) from the pressure sensors 41, 42 are converted into target tiltings $\theta_{01}$, $\theta_{02}$ of the hydraulic pumps 1, 2 in target tilting calculation blocks 40*a*, 40*b* and then converted into current values $I_1$, $I_2$ in current value calculation blocks 40*c*, 40*d*. Control currents corresponding to the current values $I_1$, $I_2$ are output to the solenoid control valves 30, 31.

Here, the relationships between the pilot pressures represented by the sensor signals P1, P2 and the target tiltings $\theta_{01}$, $\theta_{02}$ in the blocks 40*a*, 40*b* are set such that as the pilot pressures rise, the target tiltings $\theta_{01}$, $\theta_{02}$ increase. The relationships between the target tiltings $\theta_0$, $\theta_{02}$ and the current values $I_1$, $I_2$ in the blocks 40*c*, 40*d* are set such that as the target tiltings $\theta_{01}$, $\theta_{02}$ increase, the current values $I_1$, $I_2$ increase. With those settings, as mentioned above, the solenoid control valves 30, 31 are operated to maximize the control pressures output from them when the control lever units 33, 34 are in neutral positions, and when the control lever units 33, 34 are manipulated, to lower the control pressures output from them with an increase in respective input amounts by which the control lever units 33, 34 are manipulated.

Also, the accelerator signal from the accelerator operation input unit 35 is converted into an allowable maximum torque Tp in a maximum torque calculation block 40*e* and then converted into a current value $I_3$ in a current value converter 40*f*. A control current corresponding to the current value $I_3$ is output to the solenoid control valve 32. The accelerator operation input unit 35 is manipulated by an operator, and the accelerator signal is selected depending on conditions where the operator is going to use the machine, thereby commanding the target revolution speed.

Here, the relationship between the accelerator signal and the allowable maximum torque Tp in the block 40*e* is set such that the allowable maximum torque Tp increases as the target revolution speed represented by the accelerator signal becomes higher. The relationship between the allowable maximum torque Tp and the current value $I_3$ in the block 40*f* is set such that the current value $I_3$ increases as the allowable maximum torque Tp increases. With those settings, as mentioned above, the solenoid control valve 32 is operated to lower the control pressure output from it as the target revolution speed represented by the accelerator signal from the accelerator operation input unit 35 becomes higher.

Further, the detection signal from the position sensor 45 (tilting signal $\theta_1$ of the hydraulic pump 1) and the detection signal from the pressure sensor 43 (delivery pressure signal $P_{D1}$ of the hydraulic pump 1) are input to a torque calculation block 40*g*, while the detection signal from the position sensor 46 (tilting signal $\theta_2$ of the hydraulic pump 2) and the detection signal from the pressure sensor 44 (delivery pressure signal $P_{D2}$ of the hydraulic pump 2) are input to a torque calculation block 40*h*. Load torques $T_{r1}$, $T_{r2}$ of the hydraulic pumps 1, 2 are calculated in those blocks 40*g*, 40*h* from the following formulae:

$$T_{r1}=K\cdot\theta_1\cdot P_{D1}$$

$$T_{r2}=K\cdot\theta_2\cdot PD_2 \text{ (K: constant)}$$

The load torques $T_{r1}$, $Tr_2$ are added in an adder 40*i* to determine a total of the load torques of the hydraulic pumps 1, 2. The total of the load torques is output as an engine load torque signal T to the engine controller 50.

Figure 7:
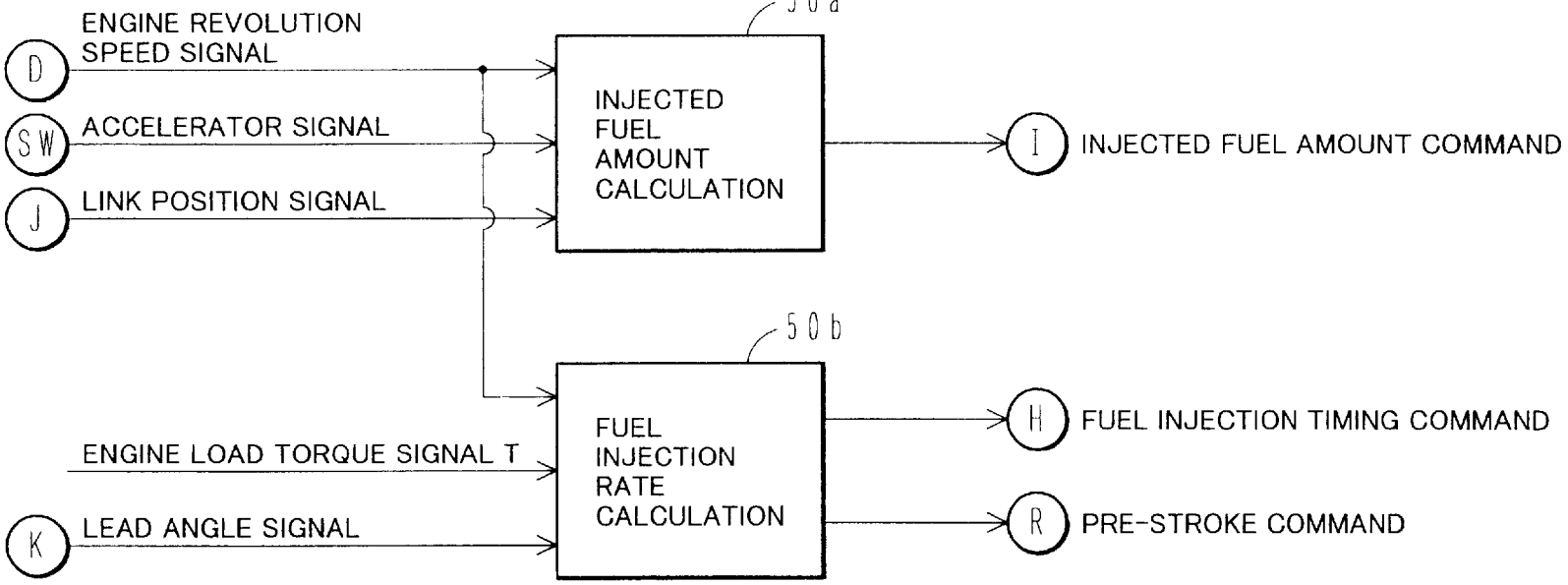
FIG. 7 is a functional block diagram showing a sequence of processing steps in an engine controller.

FIG. 7 shows a sequence of processing steps in the engine controller 50 in the form of a functional block diagram. In FIG. 7, the accelerator signal from the accelerator operation input unit 35, the detection signal from the revolution speed sensor 51 (engine revolution speed signal), and the detection signal from the link position sensor 52 (link position signal) are converted into an injected fuel amount command in an injected fuel amount calculation block 50*a*. A control current corresponding to the injected fuel amount command is output to the governor actuator 54. The processing executed in the injected fuel amount calculation block 50*a* is known. More specifically, when one of the target revolution speed represented by the accelerator signal and the engine revolution speed detected by the revolution speed sensor 52 is changed such that a revolution speed deviation ΔN resulted from subtracting the detected revolution speed from the target revolution speed increases in the positive direction, the link position of the link mechanism 64 is adjusted to increase the injected fuel amount. On the other hand, when the revolution speed deviation ΔN decreases in the negative direction, the link position of the link mechanism 64 is adjusted to reduce the injected fuel amount. The link position signal is used for feedback control.

Further, the detection signal from the revolution speed sensor 51 (engine revolution speed signal), the engine load torque signal T from the pump controller 40, and the detection signal from the lead angle sensor 53 (lead angle signal) are converted into a pre-stroke control command and a fuel injection timing command in a fuel injection rate calculation block 50*b*. Control currents corresponding to the pre-stroke control command and the fuel injection timing command are output to the pre-stroke actuator 70 and the solenoid control valve 66 of the timer actuator 55, respectively.

Figure 8:
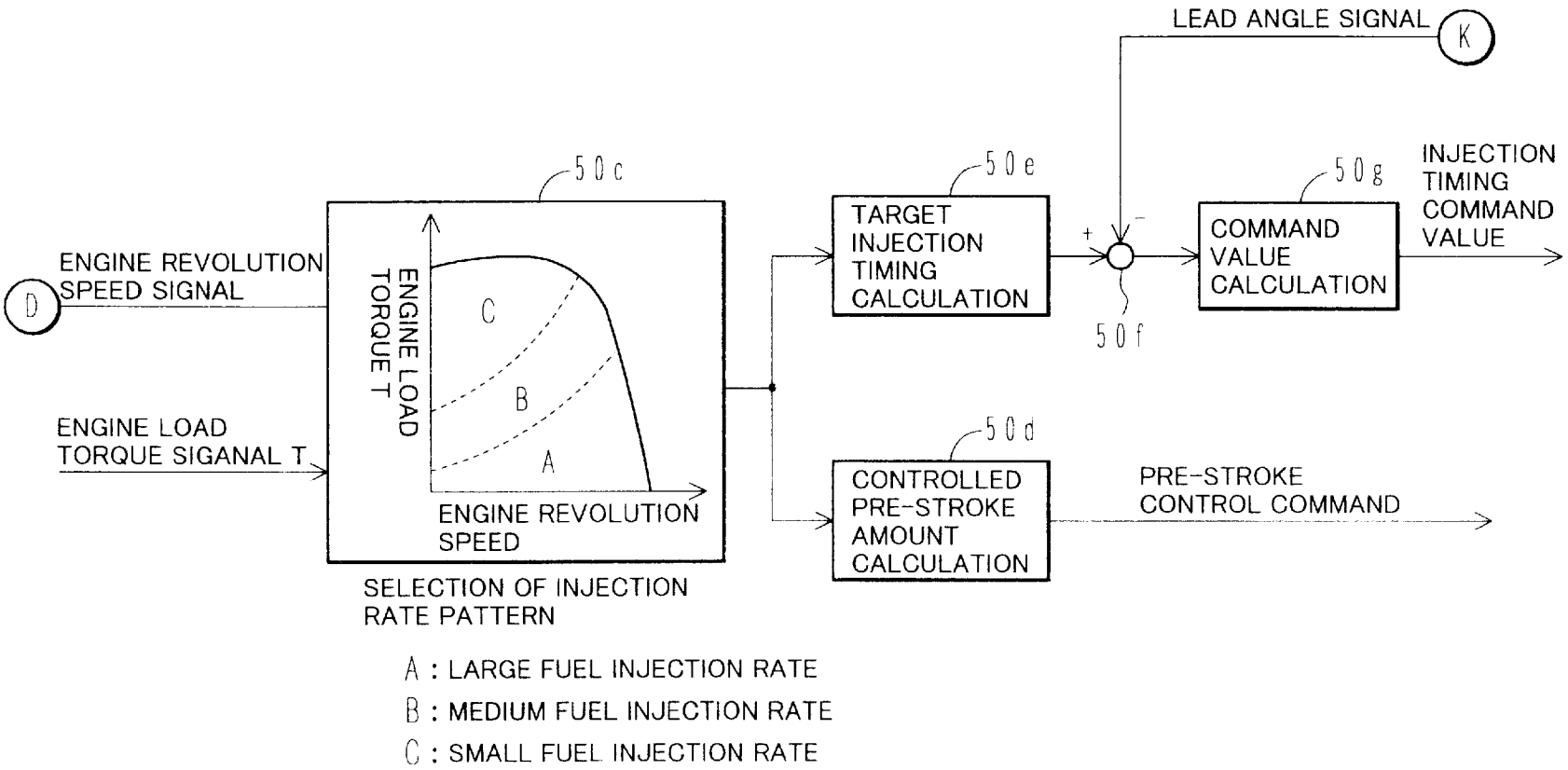
FIG. 8 is a functional block diagram showing a sequence of processing steps in a fuel injection rate calculation block in the engine controller.

FIG. 8 shows a sequence of processing steps in the fuel injection rate calculation block 50*b* in more detail. In FIG. 8, the detection signal from the revolution speed sensor 51 (engine revolution speed signal) and the engine load torque signal T from the pump controller 40 are input to an injection rate pattern selection block 50*c* where an injection rate pattern is selected depending on the engine revolution speed and the engine load torque.

Figure 9A:
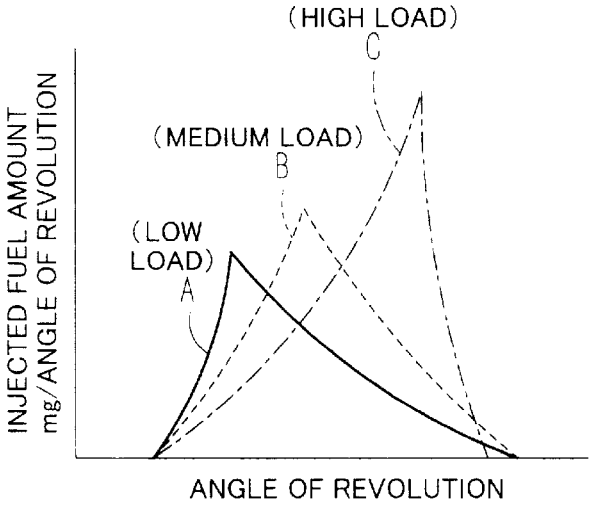
FIGS. 9A to 9D are graphs showing fuel injection patterns.
Figure 9B:
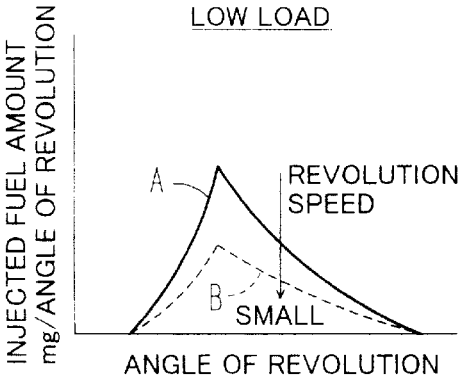
Figure 9C:
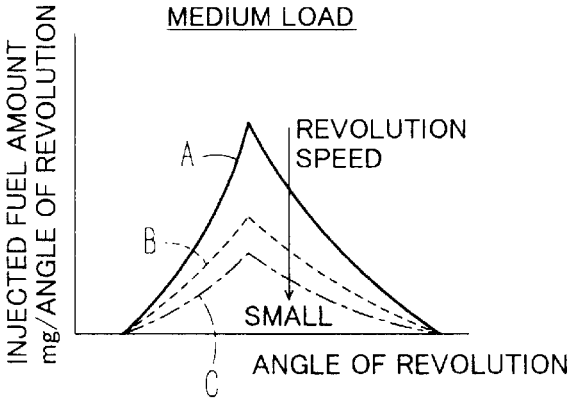
Figure 9D:
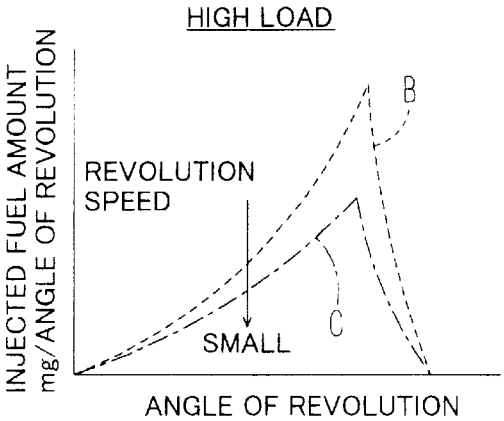

Three patterns A, B, C shown in FIGS. 9A to 9D are set as injection rate patterns depending on the engine revolution speed and the engine load torque. These patterns A, B, C are defined such that the fuel injection start timing (angle of revolution) is substantially the same for all the patterns and the fuel injection rate decreases in the order of the patterns A, B, C. Given the engine revoluton speed being constant, as shown in FIG. 9A, the pattern A (high injection rate) is selected at a low load torque (low load), the pattern B (medium injection rate) is selected at a medium load torque (medium load), and the pattern C (low injection rate) is selected at a high load torque (high load). Given the load torque being constant, as shown in FIGS. 9A, 9B and 9C, the medium injection rate pattern B or the low injection rate pattern C is selected even at a low load as the engine revolution speed lowers. In other words, as the engine load torque increases or as the engine revolution speed lowers, the injection rate pattern is selected in the order of the pattern A (high injection rate), the pattern B (medium injection rate), and the pattern C (low injection rate).

When the injection rate pattern is selected in the injection rate pattern selection block 50*c*, a controlled pre-stroke amount needed to achieve the injection rate is calculated in a controlled pre-stroke amount calculation block 50*d*. The controlled pre-stroke amount is converted into a control current as a pre-stroke control command which is output to the pre-stroke actuator 70.

On the other hand, since the pre-stroke control for changing the injection rate accompanies change of the injection timing, the fuel injection start timing (angle of revolution) must be kept substantially the same to realize the patterns A, B, C. A target injection timing calculation block 50*e* therefore calculates an injection timing modification amount for modifying change of the injection timing caused by the pre-stroke control and always keeping the fuel injection start timing (angle of revolution) constant, and adds the modification amount to basic injection timing to determine target injection timing.

A deviation between the target injection timing and the detection signal from the lead angle sensor 53 (lead angle signal) is determined in a subtractor 50*f*, and a command value calculation block 50*g* calculates an injection timing command value. The injection timing command value is converted into a control current which is output to the solenoid control valve 66 of the timer actuator 55.

Thus, as explained above, the injection rate is controlled in accordance with the injection rate pattern selected in the order of the pattern A (high injection rate), the pattern B (medium injection rate), and the pattern C (low injection rate) (see FIG. 9). As a result, the timing at which the injection rate reaches a peak is delayed in the order of the patterns A, B, C. This provides an effect equivalent to that the fuel injection timing is delayed as the engine load torque increases. In addition, since the fuel injection start timing is substantially the same for all the patterns, the fuel injection end timing is also substantially the same for all the patterns and change in the angle range of a fuel injection period with respect to the angle of engine revolution is minimized. Accordingly, the injection timing control can be performed while holding the fuel injection period within an optimum angle range.

With this embodiment thus constructed, the pump controller 40 directly and accurately calculates the load imposed on the engine by calculating the load torques $T_{r1}$, $Tr_2$ of the hydraulic pumps 1, 2 and then summing up the calculated load torques to determine the engine load torque, and the engine controller 50 determines the injection rate pattern by using the engine load torque and the engine revolution speed. The injection rate command value (controlled pre-stroke amount) depending on the engine load and the engine revolution speed can be therefore determined accurately. In addition, even when the delivery rates and the delivery pressures of the hydraulic pumps 1, 2 are frequently changed during the operation of the actuators 5, 6 and the total load of the hydraulic pumps, i.e., the engine load, is fluctuated, the fuel injection rate can be controlled with good response following the load fluctuation. As a result, it is possible to control the fuel injection rate optimally, achieve improved combustion, and enhance the engine performance.

Further, with the injection rate control of this embodiment, the injection rate pattern is determined based on the engine load torque (total load torque of the hydraulic pumps) such that the fuel injection rate reduces as the engine load torque increases or as the engine revolution speed lowers. Also, the injection rate control is performed in such a manner that the fuel injection start timing is not essentially changed regardless of the fuel injection rate. Therefore, the control can be made to delay the timing at which the injection rate reaches a peak, but not to delay the fuel injection start timing, as the engine load torque increases. This enables the control to be performed as if the fuel injection timing is delayed, while minimizing change in the angle range of the fuel injection period with respect to the angle of engine revolution. Accordingly, the injection timing control can be performed while holding the fuel injection period within an optimum angle range. It is hence possible to achieve optimum combustion, improve the combustion efficiency and fuel consumption, make exhaust gas clean while suppressing the generation of $NO_x$, and black smoke, and achieve further enhanced engine performance. In addition, a temperature rise in the engine combustion chamber can be held down and the engine reliability can be improved.

Figure 10:
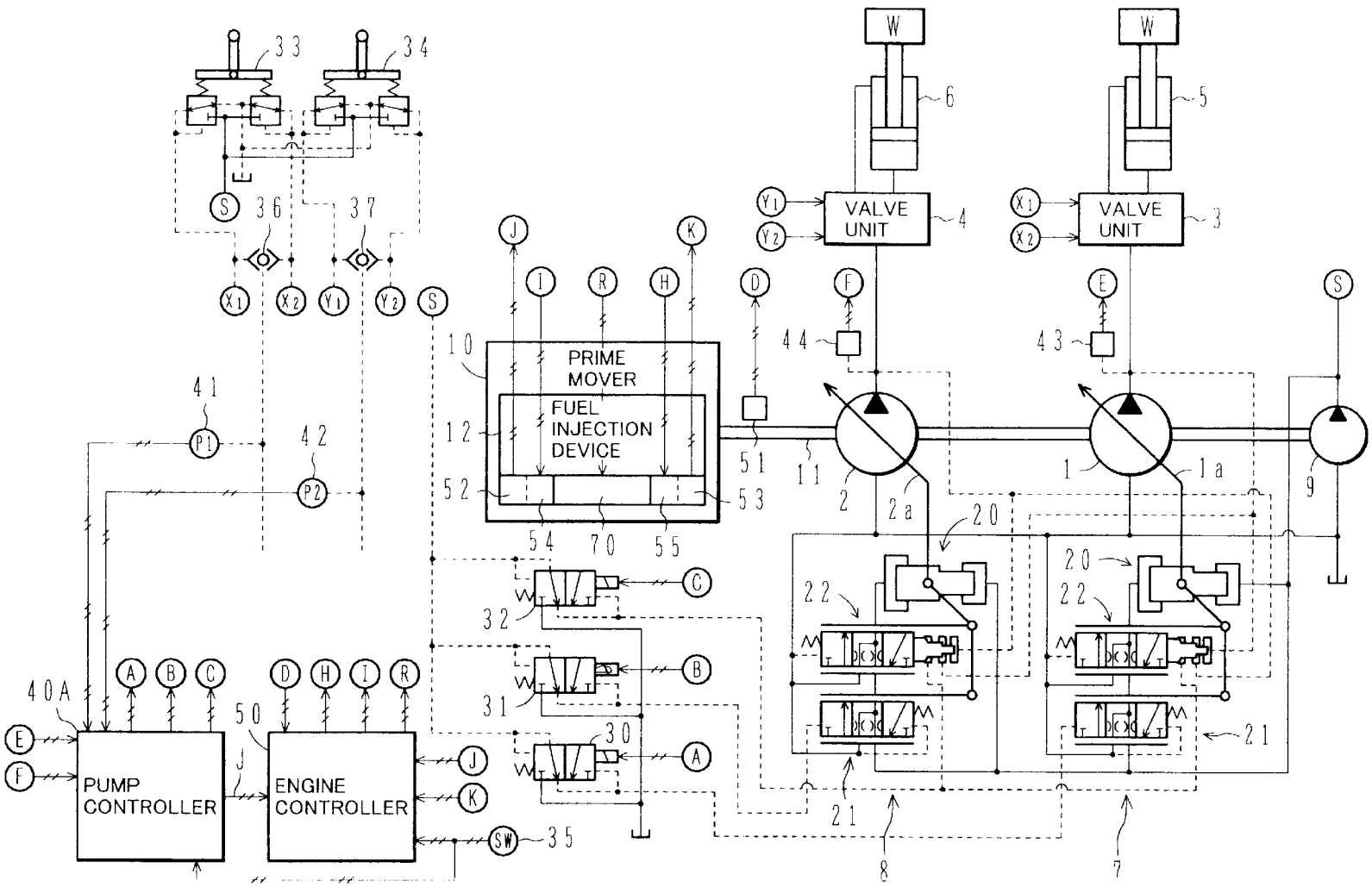
FIG. 10 is a diagram showing an entire configuration of an engine control system according to a second embodiment of the present invention along with a hydraulic circuit and a pump control system.
Figure 11:
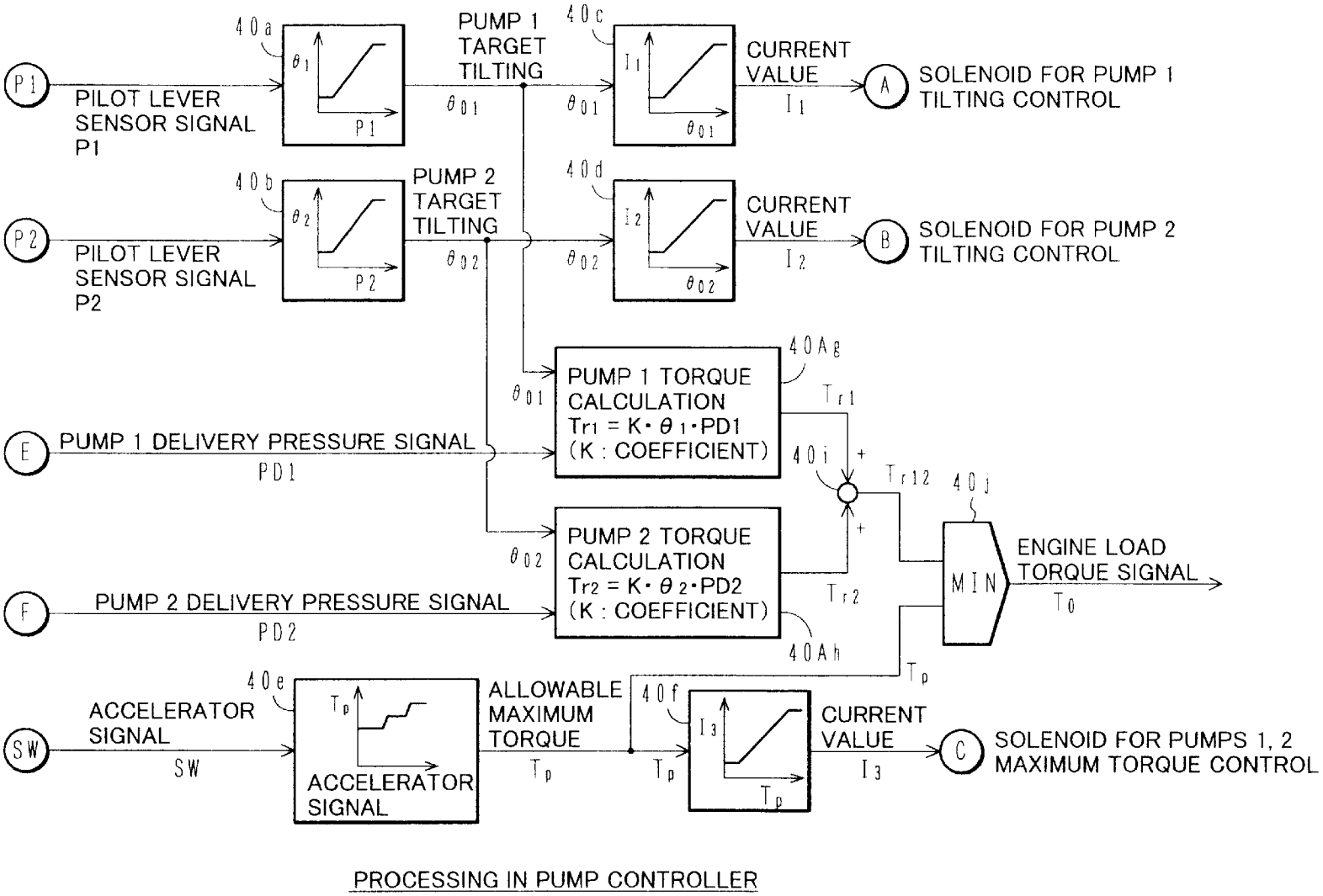
FIG. 11 is a functional block diagram showing a sequence of processing steps in a pump controller.

A second embodiment of the present invention will be explained with reference to FIGS. 10 and 11. In this embodiment, the load torque of the hydraulic pump is calculated by using a target pump tilting. In FIGS. 10 and 11, equivalent members and functions shown in FIGS. 1 and 6 are denoted by the same reference numerals.

Referring to FIG. 10, in this embodiment, there are no position sensors for detecting the tiltings of the swash plates 1*a*, 2*a* of the hydraulic pumps 1, 2, and a pump controller 40A receives only the detection signals from the pressure sensors 41, 42, 43, 44 and the accelerator signal from the accelerator operation input unit 35.

FIG. 11 shows a sequence of processing steps in the pump controller 40A in the form of a functional block diagram. In FIG. 11, respective processing steps in the target tilting calculation blocks 40*a*, 40*b*, the current value calculation blocks 40*c*, 40*d*, the maximum torque calculation block 40*e* and the current value converter 40*f* are the same as in the first embodiment shown in FIG. 6.

The target tilting $\theta_{01}$ of the hydraulic pump 1 calculated in the target tilting calculation block 40*a* and the detection signal from the pressure sensor 43 (delivery pressure signal $P_{D1}$ of the hydraulic pump 1) are input to a torque calculation block 40Ag, while the target tilting $\theta_{02}$ of the hydraulic pump 2 calculated in the target tilting calculation block 40*b* and the detection signal from the pressure sensor 44 (delivery pressure signal $P_{D2}$ of the hydraulic pump 2) are input to a torque calculation block 40Ah. Load torques $T_{r1}$, $Tr_2$ of the hydraulic pumps 1, 2 are calculated in those blocks 40Ag, 40Ah from the following formulae:

$$T_{r1}=K\cdot\theta_{01}\cdot P_{D1}$$

$$T_{r2}=K\cdot\theta_{02}\cdot P_{D2} \text{ (K: constant)}$$

The load torques $T_{r1}$, $Tr_2$ are added in the adder 40*i* to determine a total $T_{r12}$ of the load torques of the hydraulic pumps 1, 2. The total pump load torque $T_{r12}$ is input, along with the allowable maximum torque Tp calculated in the maximum torque calculation block 40*e*, to a minimum value selection block 40*j* which selects smaller one of the two torques input thereto.

As stated above, the tiltings of the hydraulic pumps 1, 2 are controlled by the regulators 7, 8 so that as the delivery pressures of the hydraulic pumps 1, 2 rise or as the target revolution speed input from the accelerator operation input unit 35 lowers, the maximum values of the delivery rates of the hydraulic pumps 1, 2 are reduced to keep the total load of the hydraulic pumps 1, 2 from exceeding the output torque of the prime mover 10. More specifically, when the total load torque of the hydraulic pumps 1, 2 is going to exceed the allowable maximum torque Tp in a condition where the target tiltings $\theta_{01}$, $\theta_{02}$ of the hydraulic pumps 1, 2 calculated in the target tilting calculation blocks 40*a*, 40*b* are increased, the tiltings of the hydraulic pumps 1, 2 are controlled not to exceed the respective target tiltings at that time. Thus, by selecting smaller one of the total pump load torque $T_{r12}$ and the allowable maximum torque Tp in the minimum value selection block 40*j*, a value corresponding to the actual load torque of the hydraulic pumps 1, 2 is determined.

The load torque selected in the minimum value selection block 40*j* is output as an engine load torque signal To to the engine controller 50.

With this embodiment, since the total load torque of the hydraulic pumps 1, 2 (engine load torque) is determined by using the target pump tiltings which represent values before the delivery rates of the hydraulic pumps 1, 2 are actually changed, response in injection rate control following fluctuation in the engine load caused by change in the delivery rates of the hydraulic pumps 1, 2 is further improved, the injection rate control can be performed with higher accuracy, and a further improvement of combustion can be achieved. In addition, since the position sensors for detecting the swash plate positions of the hydraulic pumps 1, 2 are dispensed with, the control system can be realized at a reduced cost.

It is a matter of course that while in the above embodiments the pump controller and the engine controller are provided separately from each other, these controllers may be constituted by a single controller.

Also, while the fuel injection rate is determined by setting a plurality of injection rate patterns beforehand, a three-dimensional map among the engine load, the engine revolution speed and the fuel injection rate may be prepared so that the fuel injection rate corresponding to the engine load and the engine revolution speed may be calculated from the map.

Further, in the above embodiments, the so-called line type pump pushing the plunger by the cam is employed as the injection pump and the fuel injection rate is controlled by a combination of the concave cam and the pre-stroke control. However, injection rate control means is not limited to the illustrated one, but may be modified appropriately depending on the type of the injection pump used, etc. In a pump of the type having a common rail, for example, the fuel injection rate can be freely changed by supplying a current, which has waveform corresponding to a desired injection rate pattern, to a coil of an electromagnetic fuel injection valve.

Moreover, the delivery pressures of the hydraulic pumps 1, 2 are directly detected by the pressure sensors 43, 44 in the above embodiments. However, since there is a fixed relationship between the load pressures of the hydraulic actuators 5, 6 and the delivery pressures of the hydraulic pumps 1, 2, the delivery pressures of the hydraulic pumps 1, 2 may be obtained by detecting the load pressures of the hydraulic actuators 5, 6 and estimating them from the detected load pressures.

According to the present invention, as explained above, since the fuel injection rate of the engine is controlled by calculating the accurate load imposed on the engine, the fuel injection rate can be controlled with good response and high accuracy following load fluctuation of the engine. As a result, it is possible to control the fuel injection rate optimally, achieve improved combustion, and enhance the engine performance.

Further, according to the present invention, since a combination of the injection rate control and the injection timing control enables the control to be performed as if the fuel injection timing is delayed as the engine load increases, while minimizing change in the angle range of the fuel injection period with respect to the angle of engine revolution, the injection timing control can be performed while holding the fuel injection period within an optimum angle range. It is hence possible to achieve optimum combustion, improve the combustion efficiency and fuel consumption, make exhaust gas clean while suppressing the generation of $NO_x$ and black smoke, and achieve further enhanced engine performance. In addition, a temperature rise in the engine combustion chamber can be held down and the engine reliability can be improved.

What is claimed is:

1. An engine control system for a construction machine comprising a diesel engine, at least one variable displacement hydraulic pump rotatively driven by said engine for driving a plurality of actuators, flow rate instruction means for instructing a delivery rate of said hydraulic pump, and an electronic fuel injection device for controlling an injected fuel amount in said engine, said electronic fuel injection device including a fuel injection rate control actuator for controlling a fuel injection rate of said engine, wherein said engine control system comprises:

first detecting means for detecting a status variable of said hydraulic pump, load calculating means for calculating a load of said hydraulic pump based on a value detected by said first detecting means, and injection rate calculation control means for operating said fuel injection rate control actuator so that the fuel injection rate depending on the load of said hydraulic pump is resulted.

2. An engine control system for a construction machine according to claim 1, wherein said first detecting means comprises means for detecting a delivery pressure of said hydraulic pump and means for detecting a tilting position of said hydraulic pump, and wherein said load calculating means calculates the load of said hydraulic pump based on values detected by said delivery pressure detecting means and said tilting position detecting means.

3. An engine control system for a construction machine according to claim 1, wherein said first detecting means comprises means for detecting a delivery pressure of said hydraulic pump, and wherein said load calculating means calculates the load of said hydraulic pump based on a value detected by said delivery pressure detecting means and a target tilting corresponding to the delivery rate of said hydraulic pump instructed by said flow rate instructing means.

4. An engine control system for a construction machine according to claim 1, further comprising second detecting means for detecting a revolution speed of said engine, wherein said injection rate calculation control means determines, based on the load of said hydraulic pump and the revolution speed of said engine, an injection rate command value causing the fuel injection rate to reduce as the load of said hydraulic pump increases or as the revolution speed of said engine lowers, and wherein said electronic fuel injection device further includes injection timing control means for making control such that fuel injection start timing is not essentially changed regardless of the fuel injection rate.

5. An engine control system for a construction machine comprising a diesel engine and an electronic fuel injection device for controlling an injected fuel amount in said engine, wherein said engine control system comprises:

means for detecting a load of said engine, means for detecting a revolution speed of said engine, and fuel injection control means for making control, based on the load of said engine and the revolution speed of said engine, such that a fuel injection rate reduces as the load of said engine increases or as the revolution speed of said engine lowers, and fuel injection start timing is not essentially changed regardless of the fuel injection rate.

* * * * *